US008723889B2

(12) United States Patent
Wang et al.

(10) Patent No.: US 8,723,889 B2
(45) Date of Patent: May 13, 2014

(54) METHOD AND APPARATUS FOR PROCESSING TEMPORAL AND SPATIAL OVERLAPPING UPDATES FOR AN ELECTRONIC DISPLAY

(75) Inventors: Xiaohui Wang, Austin, TX (US); Sebastian Ahmed, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 609 days.

(21) Appl. No.: 13/013,660

(22) Filed: Jan. 25, 2011

(65) Prior Publication Data

US 2012/0188272 A1 Jul. 26, 2012

(51) Int. Cl.
*G09G 5/00* (2006.01)
*G09G 5/39* (2006.01)

(52) U.S. Cl.
USPC ..... 345/634; 345/635; 345/531

(58) Field of Classification Search
CPC ..... G09G 5/363; G09G 5/393; G09G 5/395
USPC ..... 345/536, 690, 107, 531, 545, 634, 635
See application file for complete search history.

(56) References Cited

U.S. PATENT DOCUMENTS 7,310,104 B2 12/2007 MacInnis et al.
2009/0256868 A1 10/2009 Low et al.
2011/0285730 A1* 11/2011 Lai et al. ..... 345/536

FOREIGN PATENT DOCUMENTS

WO 2008153211 A1 12/2008

OTHER PUBLICATIONS

EP Application 12151640.5-2205, International Search Report and Written Opinion, dated Apr. 12, 2012.

* cited by examiner

*Primary Examiner* — Hau Nguyen
(74) *Attorney, Agent, or Firm* — Gary Stanford

(57) ABSTRACT

A display controller including a pixel processor which processes working pixel data for each pixel of a frame, and which includes an overlap detector, a collision detector, and a construction processor. The overlap detector detects an overlap when any new pixel value of a new update region is within a region of a current update of the frame. The collision detector issues a correction request when at least one pixel within the overlap region has a begin pixel value prior to the current update that is different from an end pixel value provided by the current update, and when a new pixel value provided by the new update for the pixel is different from the end pixel value. The construction processor updates the working pixel data before the current update is completed using a new pixel value for each non-overlapping pixel.

20 Claims, 9 Drawing Sheets

METHOD AND APPARATUS FOR PROCESSING TEMPORAL AND SPATIAL OVERLAPPING UPDATES FOR AN ELECTRONIC DISPLAY

BACKGROUND OF THE INVENTION

1. Field of the Invention

The present invention relates in general to controlling an electronic display, and more specifically to a method and apparatus for processing temporal and spatial overlapping updates for an electronic display.

2. Description of the Related Art

Electronic visual displays have many forms including active displays which generate light and passive displays which modulate light. Passive displays generally consume less power since they rely upon light reflected from the display to convey visual information rather than light generated by the display, such as a back light or the like. Certain passive displays consume even less power since they are bistable in which they remain in a stable state without additional power input. An electrophoretic display, for example, is a low power passive bistable display. An electrophoretic display is a form of electronic paper (e-paper) or electronic ink display technology which appears similar to ink on paper, and which is commonly used for e-book readers (or e-readers) or the like, such as the Amazon Kindle, the Barnes & Noble Nook, and the Sony Librie, among others. An electrophoretic display utilizes less energy than conventional active displays since it does not have a back light but instead relies upon reflective light for viewing. Electrophoretic displays utilize active-matrix thin-film transistors (TFTs) which are scanned to drive display updates. Once updated, the display remains stable (bistable) so that additional scans are not necessary resulting in additional energy savings. During an update, a waveform is output to the display panel to change one or more pixels from one value to another. Each waveform provided to each pixel being updated spans multiple frame scans, so that the waveform is effectively divided into multiple waveform values in which each value is output to the panel during each frame scan. The present disclosure is illustrated using electrophoretic displays but is applicable to other types of electronic displays.

Each update has to be completed once initiated to avoid an invalid display value, or worse, possible damage or improper operation of the display panel. In certain conventional configurations, a new update is delayed until an existing update is completed. In other conventional configurations, a new update may occur simultaneously with an existing update as long as the regions do not overlap. Any overlapping pixel (i.e., same pixel value belonging to both update regions) caused a conflict so that the current update had to be completed before a new update was initiated.

In order to meet the needs of newer user-interfaces, it is desired that applications using electronic displays support concurrent updates that overlap both spatially and temporally.

BRIEF DESCRIPTION OF THE DRAWINGS

The benefits, features, and advantages of the present invention will become better understood with regard to the following description, and accompanying drawings where.

DETAILED DESCRIPTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

Figure 1:
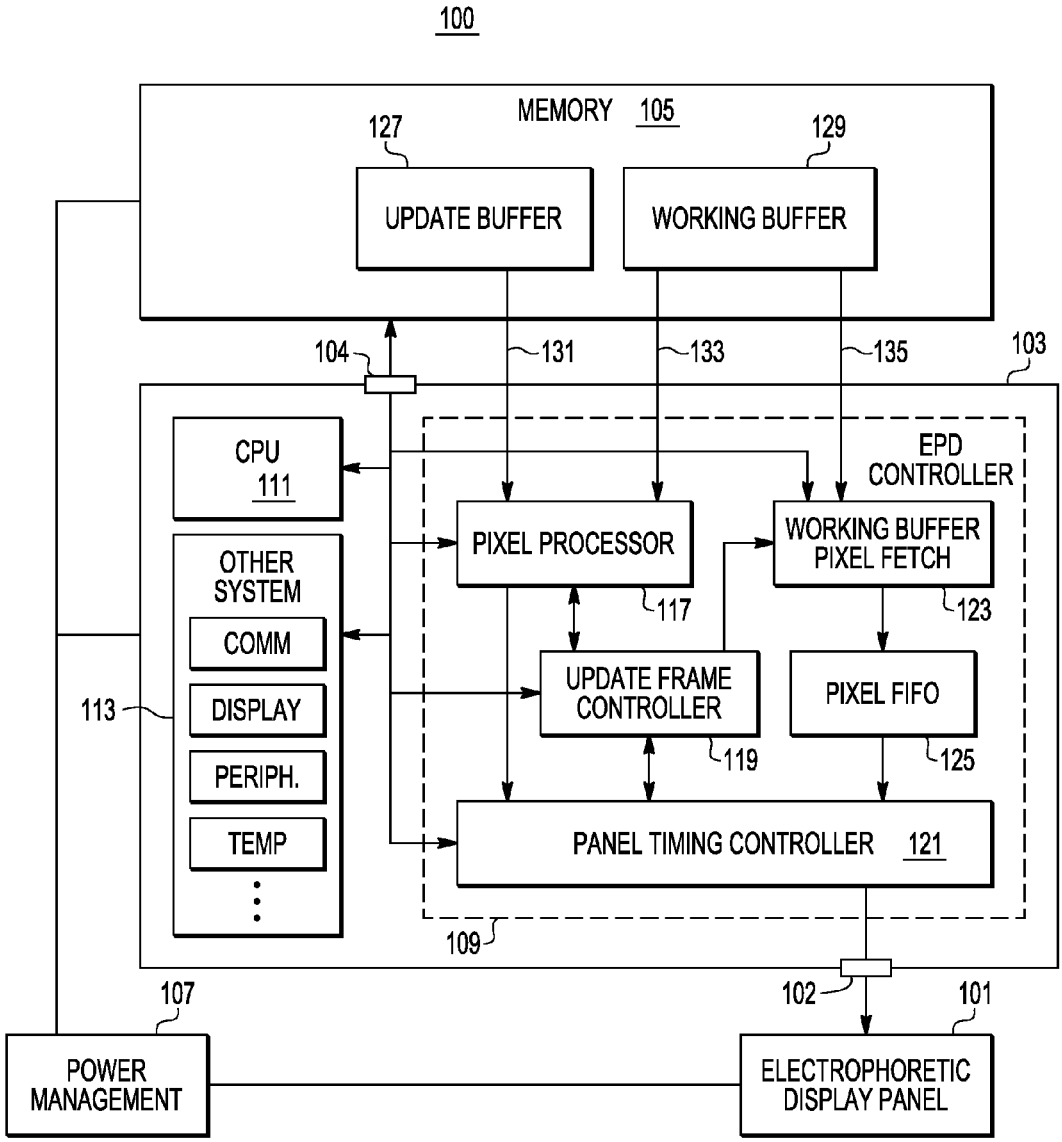
FIG. 1 is a simplified block diagram of a electronic device which processes concurrent temporal and spatial updates for an electrophoretic display (EPD) panel using an EPD controller implemented according to one embodiment.

FIG. 1 is a simplified block diagram of a electronic device 100 which processes concurrent temporal and spatial updates for an electrophoretic display (EPD) panel 101 using an EPD controller 109 implemented according to one embodiment. The electronic device 100 includes a control system 103, the EPD panel 101, memory 105 and a power management system 107. The EPD panel 101 is coupled to the control system 103 via a panel interface 102 and the memory 105 is coupled to the control system 103 via a memory interface 104. The power management system 107 provides power to the other devices and generally manages appropriate voltage and current levels as understood by those of ordinary skill in the art. The EPD panel 101 may be implemented according to any suitable format and configuration, such as incorporating active-matrix thin-film transistors (TFTs) or the like. The EPD panel 101 may have any desired or standard resolution according to any suitable aspect ratio, such as, for example, 800×600 pixels, 1200×825 pixels, etc., in which each pixel is implemented as a microcapsule or similar element positioned between electrodes (not shown). Charged particles within each microcapsule are repositioned according to an applied electric field generated by the electrodes to achieve a desired gray-scale appearance. One or more waveforms are output to the EPD panel 101 to change corresponding pixels from one pixel value to another over multiple frame scans to update the image appearing on the display.

The memory 105 incorporates any combination of random access memory (RAM) or read-only memory (ROM) or the like. The RAM portion may include any type of dynamic RAM (DRAM) or synchronous DRAM (SDRAM), such as any type or version of single date rate (SDR) SDRAM or double date rate (DDR) SDRAM and the like. The memory 105 stores an update buffer 127 and a working buffer (WB) 129. The update buffer 127 stores future pixel values to be displayed on the EPD panel 101 and the working buffer 129 stores WB pixel data which includes information representing the pixel values currently being displayed on the EPD panel 101 or currently being updated as further described herein. The memory 105 may also store software and/or application programs and the like for execution by a central processing unit (CPU) 111 as further described herein. The memory interface 104, which is coupled to or otherwise implemented as a bus or bus system or the like, enables data and information to be transferred between the memory 105 an the control system 103.

In the illustrated embodiment, the control system 103 is configured as a system on a chip (SOC) device which includes an EPD controller 109, the CPU 111 and various other system modules or devices 113. The other system 113, for example, may include any one or more of communication (COMM) functions, DISPLAY functions, peripheral (PERIPH) functions, temperature (TEMP) functions, etc. The COMM functions, for example, may include controllers and the like to implement one or more of various communication interfaces, such as universal serial bus (USB) interfaces, Bluetooth interfaces, mobile communication interfaces (e.g., 3G or $3^{rd}$ Generation, 4G or $4^{th}$ Generation, CDMA, etc.), among others. The DISPLAY functions may include controllers and the like for different types of electronic display devices that may be used in the system, such as a liquid crystal display (LCD) or the like. The PERIPH functions are used to interface any other type of peripheral or input/output (I/O) devices, such as one or more buttons or button interfaces, a keypad, a touchpad interface, etc. The TEMP function may be used for interfacing one or more temperature sensors or the like. Other functions are contemplated, such as encryption/decryption functions, graphic accelerators, memory card interfaces (flash cards the like), etc. Although the control system 103 is shown as a SOC device including the CPU 111 embedded within a common integrated circuit (IC), alternative configurations are contemplated, such as discrete IC devices or blocks or the like.

The EPD controller 109 includes the control and interface blocks, modules and functions for interfacing and controlling the EPD panel 101 according to instructions and programming by the CPU 111. As shown, EPD controller 109 includes a pixel processor 117, an update frame controller 119, a panel timing controller 121, a working buffer pixel fetch block 123, and a pixel first-in, first out (FIFO) 125. The memory interface 104 enables communication between various function blocks within the control system 103, such as between the CPU 111, the other system devices 113, and modules within the EPD controller 109, such as the pixel processor 117, the update frame controller 119 and the panel timing controller 121. The CPU 111 executes application programs which ultimately control or otherwise determine what is displayed on EPD panel 101. The CPU 111 generates new pixel values and stores them into the update buffer 127. The pixel processor 117 retrieves new pixel values from the update buffer via a data interface 131 and retrieves corresponding pixel value information from the working buffer 129 via another data interface 133. The data interfaces 131 and 133 are shown as separate interfaces for purposes of illustration, where it is understood that the memory interface 104 may be used to transfer information between the memory 105 and the EPD controller 109. The WB pixel data retrieved from the working buffer 129 corresponds with the pixel locations to be updated by the new pixel values in the update buffer 127. In general, the pixel processor 117 updates the WB pixel data in the working buffer 129 based on the new pixel values from the update buffer 127.

As described herein, an update is defined within a rectangular-shaped area or region which encompasses a subset of the pixels up to all of the pixels of the display. Multiple updates may occur simultaneously (temporal overlap) and the update regions may spatially overlap. Although each pixel within an update region may be changed, one or more pixels within the update region may remain unmodified. When any of the new pixel values for a new update region are within a region already being updated by a prior update process, then an overlap condition occurs. An update process of a pixel value should not be interrupted until completed to avoid invalid results, improper operation, or potential malfunction or even damage to the EPD panel 101. The pixel processor 117 determines whether any pixel collisions occur within the overlap region, in which a pixel collision means that a new update might otherwise interfere with or interrupt a current update of the pixel. In the event of a pixel collision, the pixel processor 117 prevents the interruption and requests a collision correction to be sent to the CPU 111 to resolve the conflict with one or more future updates. In one embodiment, the collision correction request is in the form of an interrupt to the CPU 111, which processes the interrupt to identify the collision conflict and to formulate a new update to correct the conflicting pixels.

The panel timing controller 121 includes a lookup table (LUT) memory 1005 (FIG. 10) including multiple LUTs which are used to process the updates. For each new update, one LUT is assigned to the new update region so that the LUT becomes active, and that LUT remains actively assigned to that region until the update is completed. The LUT assignment may be handled by any suitable processing block, such as the CPU 111, the update frame controller 119, etc. The update frame controller 119 manages each active LUT by loading the LUT with new waveform data prior to each new frame scan. The pixel processor 117 accesses the update frame controller 119 to identify any temporal collisions between a new update and any updates currently being processed as further described herein. The update frame controller 119 provides control signals to the working buffer pixel fetch block 123 indicating that valid data is pending and that working buffer construction of WB pixel data has been completed, so that the working buffer pixel fetch block 123 may begin pre-fetching WB pixel data from the working buffer 129 via an interface 135 for storage into the pixel FIFO 125 at the beginning the next vertical blanking period. The interface 135 is shown as a separate interface but may be implemented via the memory interface 104. The pixel FIFO 125 provides the retrieved WB pixel data to the panel timing controller 121, which uses the LUT memory 1005 to convert pixel data into the waveform values provided to the EPD panel 101.

Figure 2:
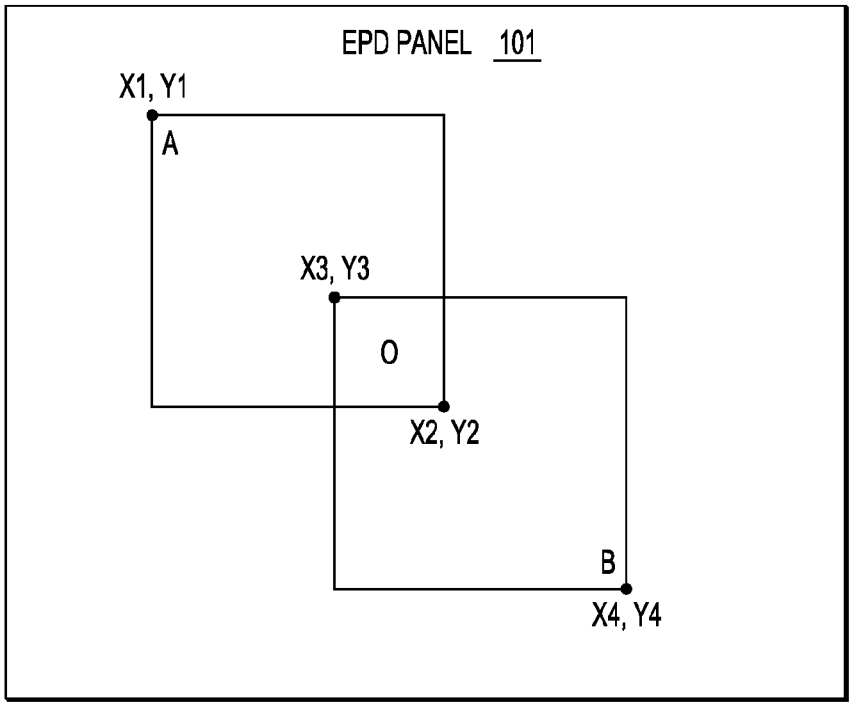
FIG. 2 is a figurative diagram of a front view of the EPD panel of FIG. 1 with spatially overlapping update regions A and B.

FIG. 2 is a figurative diagram of a front view of the EPD panel 101 with spatially overlapping update regions A and B. Although only two concurrent update regions are shown, it is noted that any number of simultaneous updates may be processed at the same time up to the total number LUTs. The EPD panel 101 is organized as an array or "frame" of pixels organized into X rows and Y columns. The X value denotes row numbers which increase from right to left and the Y value denotes column numbers which increase from top to bottom. Each update region has a rectangular shape which is defined between a pair of X, Y coordinates including an upper-left coordinate and a lower-right coordinate defining the included pixel area of the update region. As shown, update region A is defined between coordinates X1, Y1 and X2, Y2 and update region B is defined between coordinates X3, Y3 and X4, Y4. Each update region defines the periphery of pixel value changes in which any subset up to all of the pixels within the region may be updated. Thus, for any given update, any number of the pixel values may remain unmodified while the remaining number of pixels are updated from one value to another. It is possible that an update is issued in which none of the pixel values within the update region are updated (all pixel values within update region remain unchanged), and it is also possible that an update is issued in which all of the pixel values within the update region are changed.

Since X2>X3 and Y2>Y3 as shown, the regions A and B spatially overlap. An overlap region O is shown defined between coordinates X3, Y3 and X2, Y2. It is assumed that the update for region A is received first and that the update for region B is received after the update for region A. Although the update regions spatially overlap, if the "current" update for region A is completed before the "new" update for region B is received, then the new update for region B does not temporally overlap the current update for region A. Thus, the update for region B may proceed without conflict. If, however, the update for region B begins before the update for region A is completed (while region A is still being updated), then the two update regions A and B overlap both spatially and temporally. In conventional configurations, a new update (e.g., for region B) which both spatially and temporally overlaps a current update (e.g., for region A) was not allowed to be initiated until the current update was completed. As described herein, the working pixel data within the overlap region O are evaluated on a pixel-by-pixel basis to determine whether any of the overlapping pixel values may be updated. The working pixel data in the non-overlapping portion of region B (including those pixels within region B but not included within region A) may start updating concurrently with the update for region A as further described herein.

Figure 3:
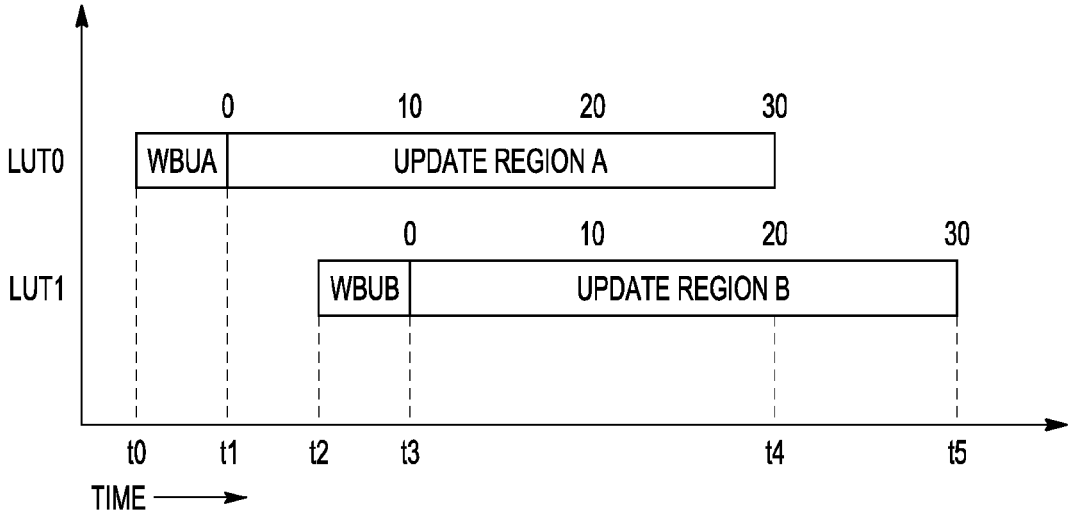
FIG. 3 is a timing diagram plotting the update regions A and B versus time according to one embodiment in which the updates overlap temporally.

FIG. 3 is a timing diagram plotting the update regions A and B versus time according to one embodiment in which the updates overlap temporally. The update for region A is assigned a first LUT, shown as LUT0, and the update for region B is assigned a second LUT, shown as LUT1, in which the assigned LUTs LUT0 and LUT1 are listed along the Y-axis. The update for region A is initiated at a time t0 when the corresponding new pixel values are detected stored in the update buffer 127 for region A. The pixel processor 117 updates the corresponding WB pixel data within the working buffer 129 based on the new pixel values in the update buffer 127 during a time period WBUA from time t0 to time t1. It is determined that the update for region A takes 30 frame scans beginning at about time t1 to a subsequent time t4. In the interim, the update for region B is initiated at a time t2 when the corresponding new pixel values are detected stored in the update buffer 127 for region B. The pixel processor 117 updates the corresponding WB pixel data within the working buffer 129 based on the new pixel values in the update buffer 127 during a time period WBUB from time t2 to time t3. It is determined that the update for region B also takes 30 frame scans beginning at about time t3 to a subsequent time t5. In this case, the updates for regions A and B are concurrent (temporal overlap). Each frame scan is initiated by a vertical synchronization (VSYNC) signal in which the update for region A occurs during 30 frame scans beginning at time t1 and the update for region B occurs during 30 frame scans beginning at time t3. Both updates are synchronous with the VSYNC signal in which the 30 frame scans for the update for region B occurs during the same frame scans as 10-30 for the update for region A. FIGS. 2 and 3 collectively show that the updates for regions A and B overlap spatially and temporally.

Figure 4:
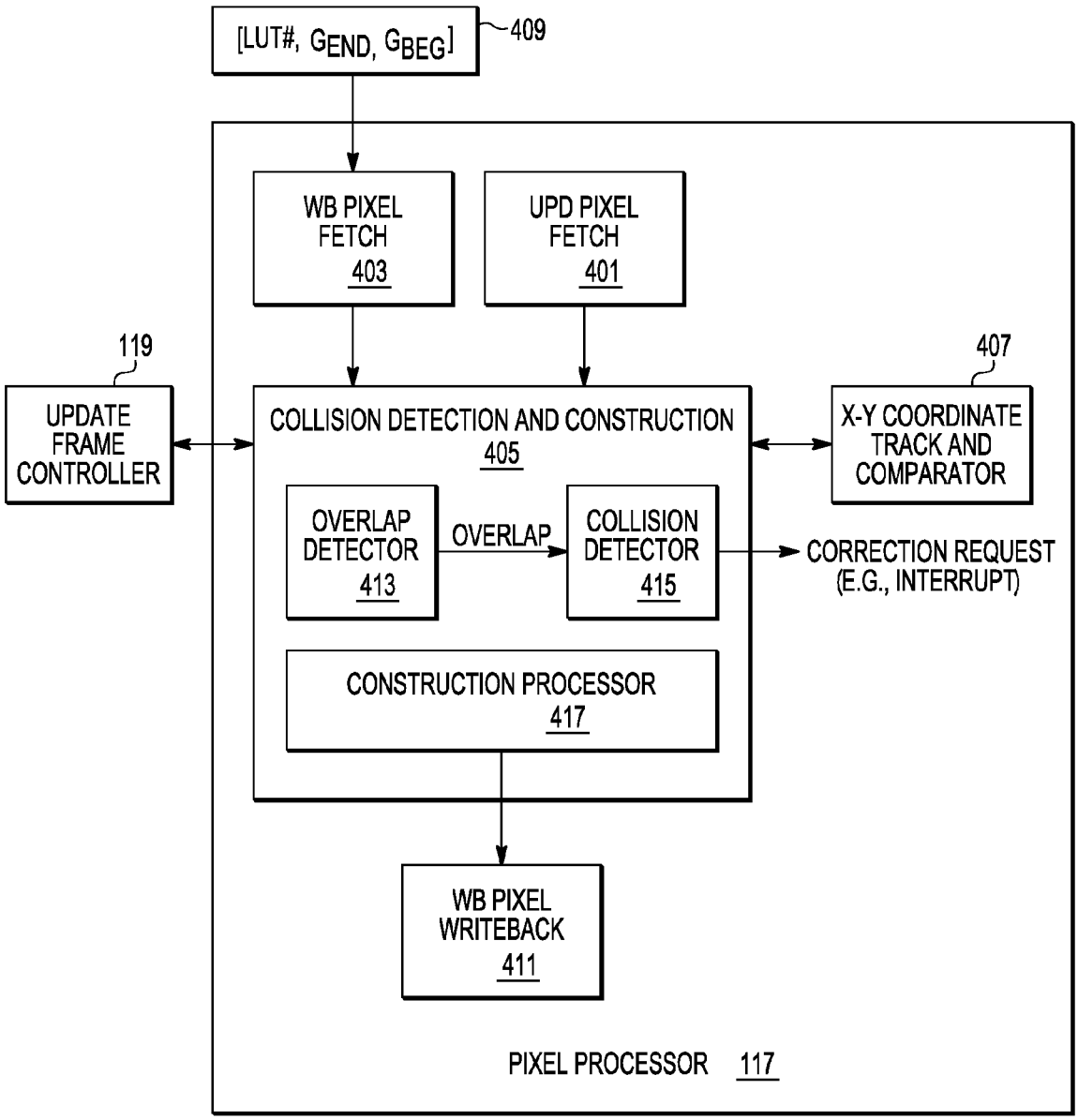
FIG. 4 is a more detailed block diagram of the pixel processor of FIG. 1 implemented according to one embodiment interfaced with the update frame controller of FIG. 1.

FIG. 4 is a more detailed block diagram of the pixel processor 117 implemented according to one embodiment interfaced with the update frame controller 119. An update (UPD) pixel fetch block 401 retrieves pixel values from the update buffer 127 and provides retrieved pixel values to a collision detection and construction block 405. The retrieved pixel values include the X, Y coordinates or otherwise corresponds with the location within the EPD panel 101 so that the location of each pixel value being updated is known. A WB pixel fetch block 403 retrieves corresponding WB pixel data from the working buffer 129, meaning the WB pixel data corresponding with the same location of the EPD panel 101, and provides the retrieved pixel information to the collision detection and construction block 405. The collision detection and construction block 405 uses the update frame controller 119 and an X-Y coordinate track and comparator 407 to determine whether the current pixel is active and if so, whether there is a collision between the new update and a current update. If no collision, then the pixel is not active (e.g., not being actively updated), so that the collision detection and construction block 405 updates the WB pixel data according to the new update information. If there is a collision of at least one pixel within the overlap region, then the collision detection and construction block 405 issues a correction request so that the colliding pixel(s) may be corrected by a subsequent update. In one embodiment, the correction request is an interrupt to the CPU 111.

Each pixel has a predetermined number Y of gray levels, such as represented by pixel values ranging from $G_0$ for a black pixel to $G_{Y-1}$ for a white pixel. In one embodiment, for example, Y=16 gray levels are defined, or $G_0, G_1, \ldots, G_{15}$. In one embodiment as illustrated in simplified format at 409, the WB pixel data retrieved by the pixel processor 117 for each pixel to be updated includes a LUT number (LUT#), a beginning value $G_{BEG}$, and an end value $G_{END}$. LUT# identifies a LUT to which the pixel was previously assigned for a prior update which has completed, or to which the pixel is currently assigned if the pixel is involved in an update which is currently processing. $G_{BEG}$ identifies an initial gray level of the pixel and $G_{END}$ identifies the ending gray level to which the pixel was changed (for a completed update) or to which the pixel is currently being changed (for a currently active update). The LUT assigned to the update is programmed with waveform data with multiple waveform values in which each waveform value is accessed using the pixel values of the WB pixel data. In one embodiment, for example, the pixel values $G_{BEG}$ and $G_{END}$ are collectively used as an index value to access the corresponding waveform value in the LUT identified by LUT# for the current frame scan. The pixel is changed over multiple frame scans in which the LUT is reprogrammed with new waveform data prior to each frame scan. The same pixel values are used for each access for each frame scan, yet a new and potentially different waveform value is retrieved from the LUT. In this manner, the LUT outputs a series of consecutive waveform values over multiple frame scans to change the gray level of a pixel from $G_{BEG}$ to $G_{END}$.

The consecutive set of waveform values over multiple frame scans is converted to the appropriate waveform applied to the pixel cell over time. As previously noted, it is not desired to interrupt the update process so that the process should be completed once started. If $G_{END}=G_{BEG}$, then the LUT (or the panel timing controller 121) outputs a "default" value which does not change the pixel. The number of frame scans to update a pixel depends upon the mode or update resolution type. A fast update for low resolution for black and white (B&W, or bi-state) uses a fewer number of frame scans (e.g., 10 frames) for achieving the update. A slow update for a medium resolution with a mid-range number of gray levels (e.g., 4 gray levels) uses a higher number of frame scans (e.g., 30 frames) to complete the update. A very slow update for a high or maximum resolution with a high number of gray levels (e.g., 16 gray levels) uses an even higher number of frame scans (e.g., 50 frames) to complete the update.

In the illustrated embodiment, the collision detection and construction block 405 includes an overlap detector 413 which determines an OVERLAP condition. The OVERLAP condition is true when at least one pixel within a new update region overlaps with a currently active update region thus forming an overlap region with at least one overlap pixel. The collision detection and construction block 405 further includes a collision detector 415 which determines, upon detection of the OVERLAP condition, whether the new update collides with the current update for any pixel within the overlap region. In general, a collision occurs when an overlap pixel (pixel in the overlap region) will not be correctly updated to the new pixel value provided by the new update after completion of the current update and the new update. This may occur, for example, when the pixel is part of a current update that cannot be interrupted by the new update. In the event of a collision, the collision detector 415 issues a correction request so that any overlapping and colliding pixels may be properly corrected by a subsequent update. In one embodiment, the correction request is in the form of an interrupt to the CPU 111, which issues the subsequent update. The collision detection and construction block 405 further includes a construction processor 417 which updates the WB pixel data for non-overlapping and/or non-colliding pixel according to each new update. Each new update includes a new pixel value $G_{NEW}$ for each pixel in the new update region to be updated, and a new LUT number $LUT_{NEW}$ identifies one of the LUTs within the LUT memory 1005 which is assigned to the new update. In particular, the LUT# is updated with $LUT_{NEW}$ indicating the assigned LUT for the new update, the $G_{END}$ value replaces $G_{BEG}$ (since $G_{END}$ represents the current value of the pixel from a prior update), and $G_{END}$ value is replaced with the $G_{NEW}$ value for the pixel. The updated WB pixel data is then written back to the working buffer 129 via a WB pixel writeback block 411.

Figure 5:
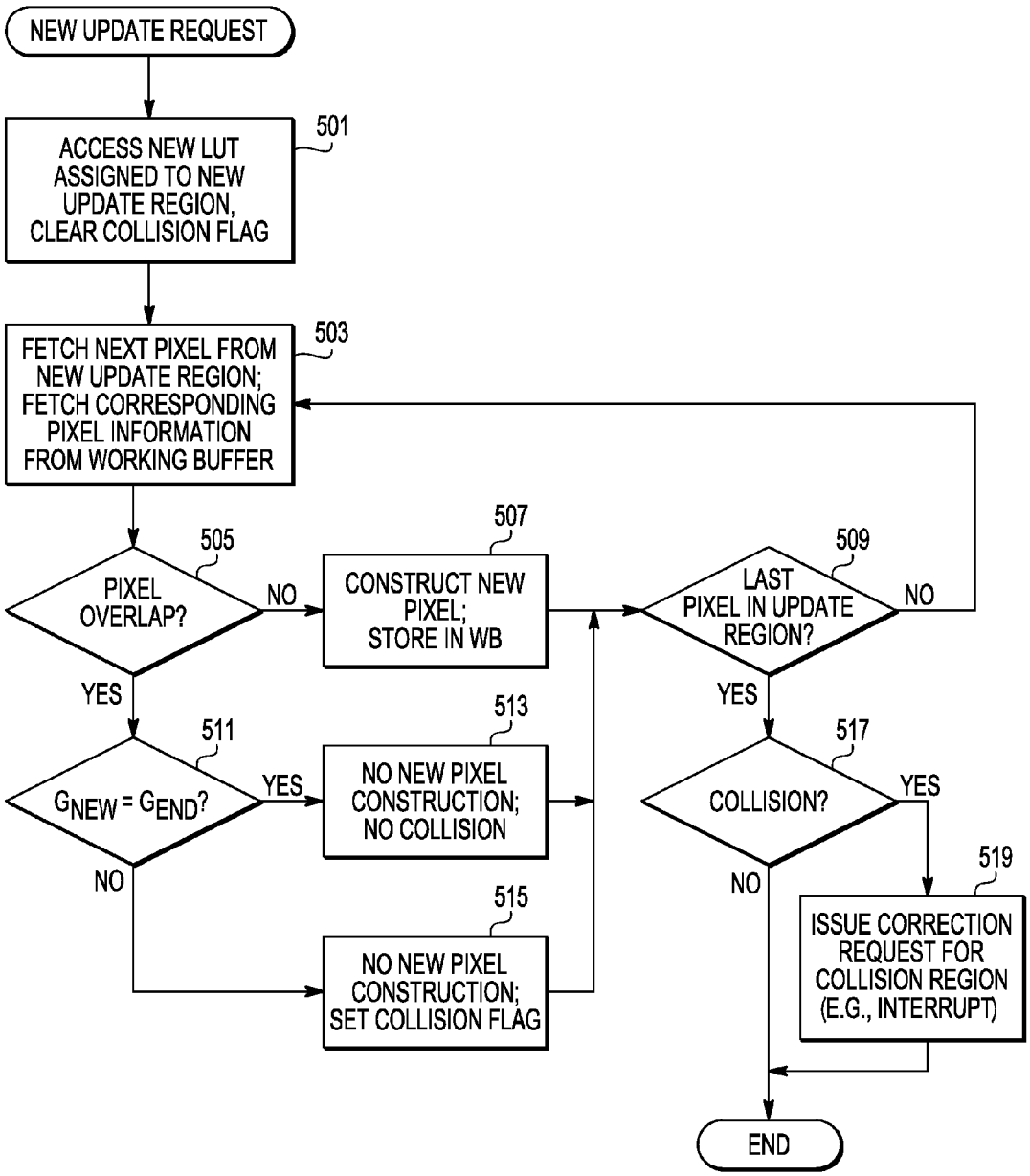
FIG. 5 is a flowchart diagram illustrating operation of the pixel processor of FIG. 1 according to one embodiment in response to a new update request.

FIG. 5 is a flowchart diagram illustrating operation of the pixel processor 117 according to one embodiment in response to a new update request. At first block 501, the new LUT (using $LUT_{NEW}$) which is assigned to the new update region is accessed. Also, a COLLISION flag is cleared. At next block 503, the next pixel from the new update region ($G_{NEW}$) within the update buffer 127 is fetched via the UPD pixel fetch block 401, along with the X, Y coordinate identifying the location of the pixel to be updated. Also within block 503, the corresponding WB pixel data from the working buffer 129 is fetched via the WB pixel fetch block 403.

Figure 6:
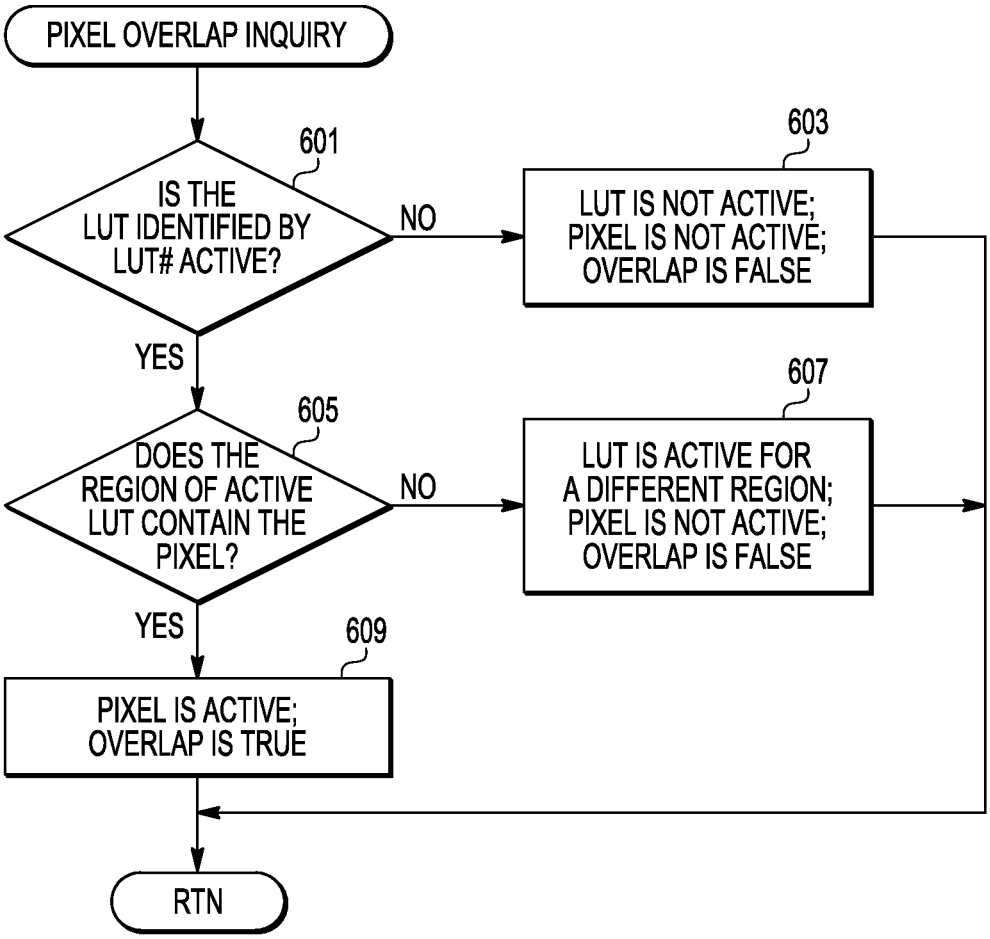
FIG. 6 is a flowchart diagram illustrating a pixel overlap determination according to one embodiment performed by the overlap detector of FIG. 4.

At next block 505, the overlap detector 413 of the collision detection and construction block 405 determines whether there is a pixel overlap. FIG. 6 is a flowchart diagram illustrating a pixel overlap determination according to one embodiment performed by the overlap detector 413 for block 505. At a first block 601, it is queried whether the WB pixel LUT, identified by the LUT# such as shown at 409, is active. In one embodiment, the overlap detector 413 consults the update frame controller 119 using the LUT# to determine whether the corresponding LUT is currently active. If the LUT identified by LUT# is not active, then operation proceeds to block 603 in which it is determined that the corresponding pixel is not currently active so that OVERLAP is false. Operation then returns to block 505 of FIG. 5 with OVERLAP false. If instead the LUT is active as determined at block 601, operation proceeds to block 605 in which it is queried whether the region assigned to the active LUT contains the pixel location of the pixel. Referring back to FIG. 4, the overlap detector 413 consults the X-Y coordinate track and comparator 407 to determine whether there is a spatial overlap. The X, Y location of the new pixel value retrieved from the update buffer 127 is compared with the X, Y coordinates of the region assigned to the active LUT (identified by LUT#) to make this determination. If the pixel is not located within the region of the active LUT, the operation proceeds to block 607 in which it is determined that the LUT is active for a region that does not include the pixel location of the new pixel value. Thus, the corresponding pixel is not currently active, and operation returns with OVERLAP false. If instead the LUT is assigned to a region which does contain the pixel location of the new pixel, operation proceeds to block 609 in which it is determined that the pixel location is active (within region of a currently active update) and operation returns with OVERLAP true.

Referring back to block 505 of FIG. 5, if OVERLAP is false, operation proceeds to block 507 in which the construction processor 417 constructs the new pixel data and stores the corresponding updated WB pixel data into the working buffer 129. As an example, if the old WB pixel data is [$LUT_{OLD}$, $G_{END}$, $G_{BEG}$], then the new WB pixel data using $LUT_{NEW}$ and $G_{NEW}$ is [$LUT_{NEW}$, $G_{NEW}$, $G_{END}$] so that the pixel will be changed from $G_{END}$ to $G_{NEW}$ using $LUT_{NEW}$. Operation then proceeds to block 509 in which it is queried whether the current pixel is the last pixel in the new update region. If not, operation returns to block 503 to fetch the next new pixel and WB pixel data from the update and working buffers 127 and 129. Operation loops between blocks 503-509 when the pixels of the new update do not overlap with any active pixels. In one case, the new update may be the only update, such as, for example, the update for region A before initiation of the update for region B in FIG. 3. Alternatively, the regions for the new update and an existing update temporally overlap but do not spatially overlap. It is appreciated that any number of concurrent temporal updates, up to a predetermined maximum number of LUTs) which do not spatially overlap may be processed simultaneously without conflict.

If instead OVERLAP is true as determined at block 505, then operation proceeds instead to block 511 in which it is queried by the collision detector 415 whether the $G_{NEW}$ value for the pixel from the update buffer 127 is equal to the $G_{END}$ value from the working buffer 129. If $G_{NEW}=G_{END}$, then operation proceeds to block 513 in which it is determined that a new pixel construction is not performed for the pixel and there is no collision. In this case, although the pixel is active and within an overlapping region of at least two updates, there is no collision since the current value of the pixel is the same as the new value so that the pixel value would not be modified by the new update. After block 513 operation proceeds to block 509 to determine whether there are any additional pixels in the new update region. If instead $G_{NEW}$ does not equal $G_{END}$ as determined at block 511 by the collision detector 415, then operation proceeds instead to block 515 in which the pixel is not further constructed and the COLLISION flag is set to true. In this case, if the pixel is being updated from $G_{BEG}$ to $G_{END}$, then modification of $G_{END}$ to $G_{NEW}$ potentially interrupts the current update process which may cause an invalid result, or worse, may cause failure or even damage to the EPD panel 101. Since it is desired that the pixel value subsequently be changed to $G_{NEW}$ in accordance with the new update, the new update does not totally complete so that the COLLISION flag is set to request a correction. Operation then returns to block 509 to query whether the pixel is the last in the new update region.

When the pixel is the last in the new update region as determined at block 509, operation proceeds to block 517 to query the COLLISION flag. If the COLLISION flag is false, the operation is completed. If the COLLISION flag is true, then at least one pixel collision occurred in which a pixel location within an overlapping area of multiple updates becomes invalid since not set to the latest value $G_{NEW}$, and operation proceeds instead to block 519. At block 519, a correction request is issued to correct pixel values that were not properly updated to the corresponding $G_{NEW}$ value during the new update, and operation is completed. The correction request is ultimately handled by the CPU 111, which issues a subsequent correction update to correct colliding pixel values that are not updated to the $G_{NEW}$ value. In one embodiment, the correction request is implemented as an interrupt to the CPU 111. The interrupt vector may include an identification of the colliding region or the conflicting LUT. In one embodiment, since the CPU 111 issues each new update for corresponding update regions, it may already have sufficient information to formulate the correction update to correct the colliding pixels. For example, the CPU 111 may already determine that the new update conflicted with one or more prior updates. The CPU 111 may re-issue the same update with the same update values for the same region or just for the overlapping region as the correction update after the one or more underlying updates that were collided with are completed.

With reference to FIG. 2, for example, the CPU 111 issues a correction update for the same region B or just the overlapping region O (with coordinates X3, Y3 and X2, Y2) after the current update for region A is completed. The correction update may even be for a smaller region inside the overlapping region O as long as the correction update includes the pixel locations that were not correctly updated. The correction update may be initiated after A completes and even while the original update for region B is still occurring. Assuming no additional updates and assuming a different LUT is assigned to the correction update, e.g., LUT2, then for each of the pixels in the region O, OVERLAP is false since the WB pixel data for pixels in the region O are still assigned LUT0 within the WB pixel data, in which LUT0 is no longer active. Thus, the correction values are applied to corresponding pixels of the correction update. If the correction update includes pixels outside region O (such as if the correction update includes all of region B), then OVERLAP is false so that the same results are achieved.

It is appreciated that updates which temporally overlap but which do not spatially overlap may be processed concurrently without conflict. When updates overlap both temporally and spatially, the updates may proceed concurrently for the non-overlapping region. In the overlap region, if each new value for the new update is equal to the next value of the current update, then there are no pixel collisions and the pixel values are updated to the correct values. If there is at least one pixel collision within the overlap region, then a collision is indicated and a correction request is issued to invoke a subsequent correction update to make the pixel corrections for the colliding pixels.

Figure 7:
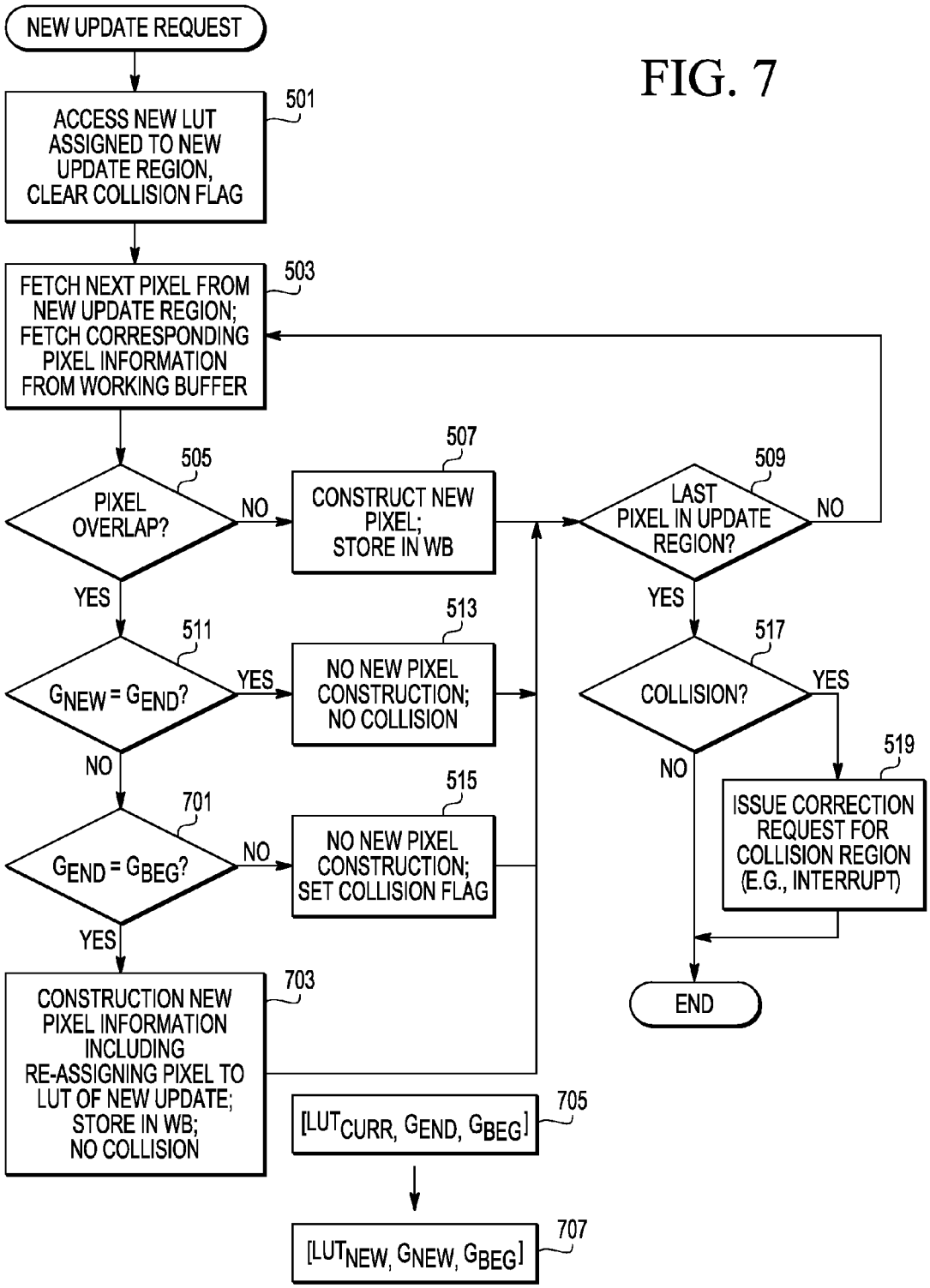
FIG. 7 is a flowchart diagram illustrating operation of the pixel processor of FIG. 1 according to an alternative embodiment in response to a new update request.

FIG. 7 is a flowchart diagram illustrating operation of the pixel processor 117 according to an alternative embodiment in response to a new update request. The flowchart of FIG. 7 is similar to that of FIG. 5 in which similar blocks assume identical reference numbers. Operation is substantially the same when there is no pixel overlap. The pixel overlap at block 505 is determined in the same manner, such as according to the flowchart of FIG. 6. When OVERLAP is true and if $G_{NEW}$ is not equal to $G_{END}$ as determined at block 511, then operation proceeds instead to an additional block 701 in which it is queried by the collision detector 415 whether $G_{END}$ is equal to $G_{BEG}$. For the current update, $G_{BEG}$ is the previous value of the pixel and $G_{END}$ is the value to which it is changing. If $G_{END}$ is not equal to $G_{BEG}$, then the pixel is actively being updated to $G_{END}$ in the current update and the new update is not yet able to change the pixel to $G_{NEW}$. Thus, operation proceeds to block 515 as previously described in which the COLLISION flag is set by the collision detector 415 so that a correction request will be issued. If, however, $G_{END}=G_{BEG}$ at block 701, then the current update is not changing the pixel value and the pixel value may be reassigned to the new update. Thus, when $G_{END}=G_{BEG}$, operation proceeds instead to block 703 in which the pixel is constructed as part of the new update, which includes reassigning the pixel to the $LUT_{NEW}$ of the new update. The re-constructed pixel is then stored into the working buffer 129 and there is no collision in this case. The WB pixel date for the current update prior to reconstruction at block 703 is shown at 705 in which it is assigned to a current LUT value $LUT_{CURR}$. The current update is using the LUT identified by $LUT_{CURR}$ to change the pixel from $G_{BEG}$ to $G_{END}$, but since $G_{END}=G_{BEG}$, the pixel value is not actually being changed. Instead, default values are being generated. The WB pixel data for the new update after reconstruction at block 703 is shown at 707 in which it is assigned to a different LUT identified by $LUT_{NEW}$. Also, $G_{END}$ is changed to $G_{NEW}$. Thus, the new update uses $LUT_{NEW}$ to change the pixel value from $G_{BEG}$ to $G_{NEW}$. After the WB pixel data is reconstructed at block 703, operation proceeds to block 509 to check whether there are additional pixels in the update region.

Operation of the pixel processor 117 according to the flowchart of FIG. 7 provides similar benefits and advantages as when operating according to the flowchart of FIG. 5. Operation according to the flowchart 7 provides the additional advantage in that the chances for collision are reduced. For example, if the update for region A does not change any of the pixels in the overlap region O, then these pixels are effectively reassigned to the update for region B and a collision is avoided. Also, the potential for updating pixels within the overlap region increases since reassigned to the new update even if there are one or more pixel collisions within the overlap region. If the COLLISION flag is set during update of the working buffer 129, then the CPU 111 issues the same new update or another update to the overlapping region after each of the one or more prior updates causing the collision have completed.

Figure 8:
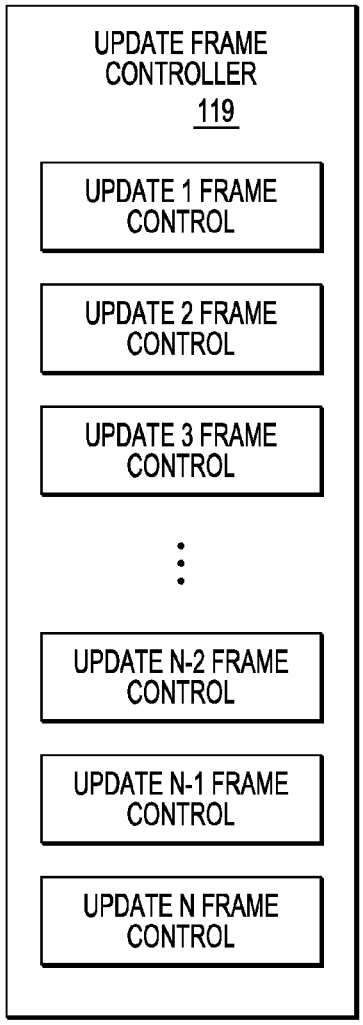
FIG. 8 is a simplified block diagram of the update frame controller of FIG. 1 according to one embodiment.

FIG. 8 is a simplified block diagram of the update frame controller 119 according to one embodiment. The update frame controller 119 includes a number N update frame control blocks numbered 1-N, each for controlling an update and a corresponding LUT assigned to that update. In one embodiment, N is 16 so that up to 16 simultaneous updates may be processed. Each update frame control block monitors the corresponding LUT and tracks timing and status of each update based on VSYNC. Further, each update frame control block loads LUT data prior to each frame scan.

Figure 9:
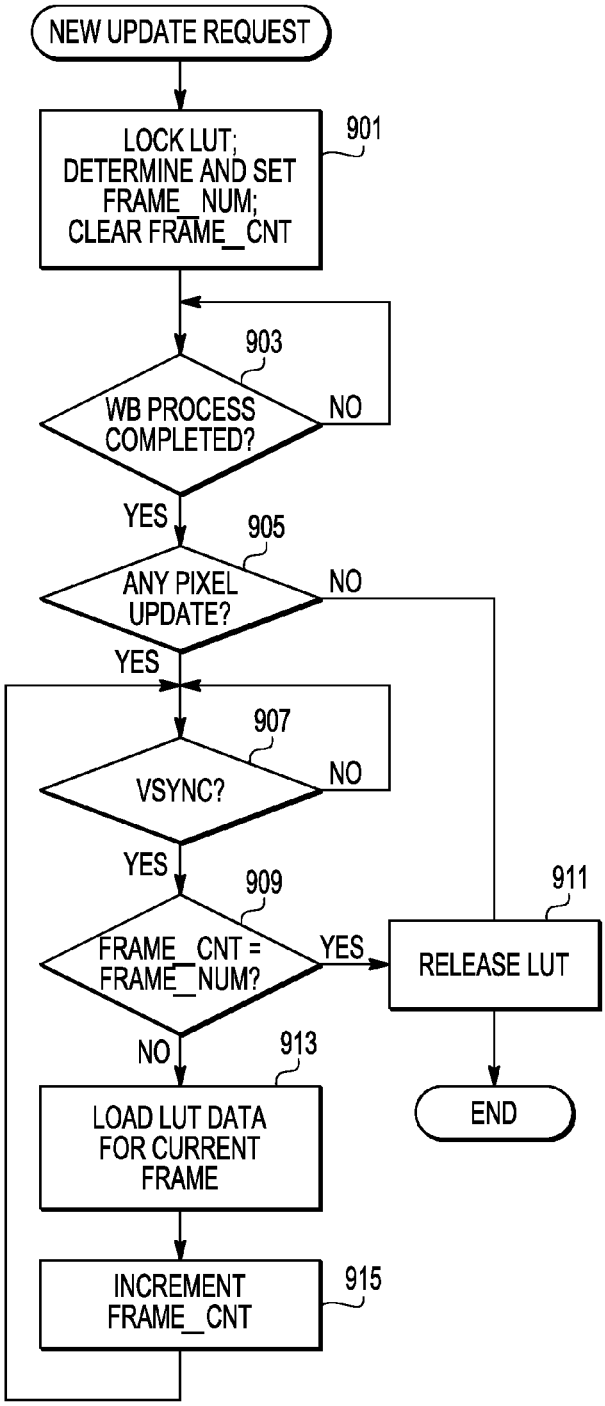
FIG. 9 is a flowchart diagram illustrating operation of each update frame control block of the update frame controller of FIG. 1 according to one embodiment.

FIG. 9 is a flowchart diagram illustrating operation of each update frame control block of the update frame controller 119 according to one embodiment. In response to a new update request, operation proceeds to a block 901 in which the assigned LUT is locked, a frame number to complete the new update is determined, a corresponding value FRAME_NUM is set to the determined number of frames, and a variable FRAME_CNT is cleared. The LUT remains locked during the update to prevent it from being assigned to a different update. Operation proceeds to block 903 in which the update frame control block queries whether the WB process for updating the working buffer 129 performed by the pixel processor 117 has completed. Operation waits or otherwise loops at block 903 until the WB pixel data for the new update within the working buffer 129 has been updated. When the WB process is complete, operation proceeds to block 905 in which it is queried whether the new update involves any pixel update within the update region. If not, operation proceeds to a block 911 in which the LUT assigned to the update is released and operation is completed. Otherwise, the working buffer pixel fetch 123 is prompted to being pre-fetching WB pixel data, and operation proceeds to block 907 to wait for the next assertion of VSYNC starting the next frame scan. Operation waits or otherwise loops at block 907 until the next assertion of VSYNC. When VSYNC is next asserted, operation proceeds to block 909 to query whether FRAME_CNT=FRAME_NUM to determine whether the total number of frame scans to complete the new update has occurred. If not, operation proceeds to block 913 in which the assigned LUT is loaded with new waveform information for the current frame scan as previously described. Then operation proceeds to next block 915 in which FRAME_CNT is incremented, and then operation loops back to block 907 to wait for the next VSYNC. Operation loops between blocks 907-915 to update the assigned LUT before each frame scan so that the appropriate waveform information is provided to the EPD panel 101 for each frame scan to complete the update. When the last frame scan for the update is completed as determined at block 909, operation proceeds to block 911 to release the LUT and operation for the update is completed.

Figure 10:
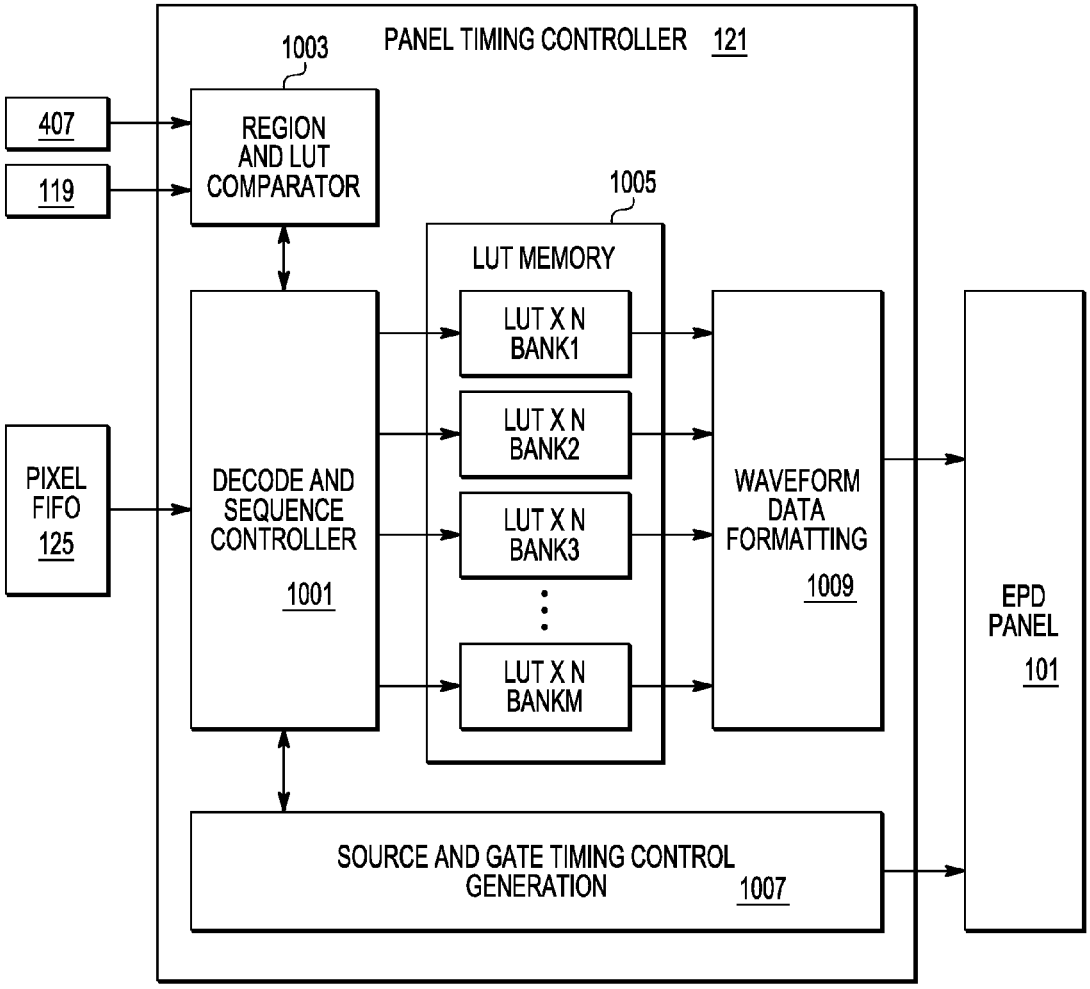
FIG. 10 is a more detailed block diagram of the panel timing controller of FIG. 1 implemented according to one embodiment.

FIG. 10 is a more detailed block diagram of the panel timing controller 121 implemented according to one embodiment. The panel timing controller 121 includes a decode and sequence controller 1001 which retrieves pixel information from the pixel FIFO 125 and which provides corresponding pixel data to the LUTs within the LUT memory 1005. A region and LUT comparator 1003, which is coupled to the decode and sequence controller 1001, accesses LUT and region information from the X-Y coordinate track and comparator 407 and the update frame controller 119. The LUT memory 1005 includes N LUTs organized into an number M banks for handling M pixels at a time. In one embodiment, M is 4 although any suitable number of LUT banks may be used for processing any suitable number of concurrent pixels. The number N corresponds with the number of update frame control blocks within the update frame controller 119. In one embodiment, N is 16 although any suitable number of LUTs may be used. Each LUT of the LUT memory 1005 outputs waveform data which is provided to a waveform data formatting block 1009, which outputs corresponding waveform data information to the EPD panel 101. The panel timing controller 121 includes a source and gate timing control generation block 1007 which provides source and gate clock control information to the EPD panel 101. The source and gate timing control generation block 1007 generates the VSYNC signal along with horizontal synchronization (HSYNC) pulses as understood by those skilled in the art.

Figure 11:
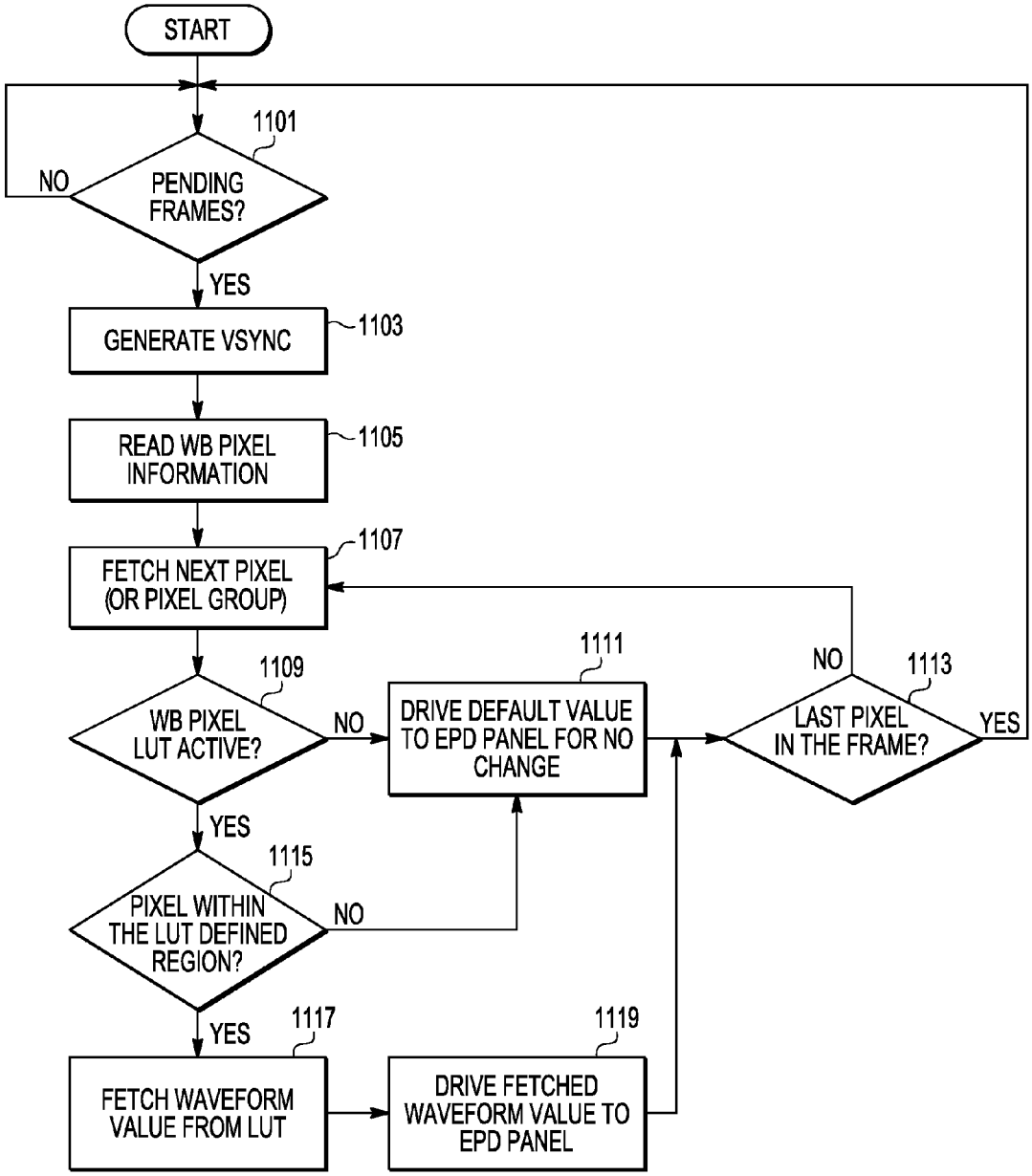
FIG. 11 is a flowchart diagram illustrating operation of the panel timing controller of FIG. 1 according to one embodiment.

FIG. 11 is a flowchart diagram illustrating operation of the panel timing controller 121 according to one embodiment. Operation remains at a first block 1101 until there are pending frames for processing one or more updates. When a frame is pending, operation proceeds to block 1103 in which a VSYNC pulse is generated. Operation then proceeds to block 1105 in which WB pixel data from the pixel FIFO 125 is retrieved. Operation proceeds to block 1107 to fetch the next pixel or pixel group (for processing M pixels in parallel). For each pixel beginning at next block 1109, it is queried whether the LUT corresponding to the LUT# in the WB pixel data is active as indicated by the region and LUT comparator 1003. If the LUT is not active, then the pixel is not being actively updated and operation proceeds to block 1111. At block 1111, the default value is driven to the EPD panel 101 so that the corresponding pixel remains unmodified. From block 1111, operation proceeds to block 1113 in which it is queried whether the pixel is the last in the current frame. If not the last pixel, operation loops back to block 1107 to fetch the next pixel or pixel group. If the last pixel of the frame, operation loops instead back to block 1101 to determine whether there are more pending frames.

Referring back to block 1109, if the WB pixel LUT is active for the pixel, then operation proceeds instead to block 1115 to query whether the current pixel is within the LUT defined region as indicated by the region and LUT comparator 1003. If not, then operation proceeds to block 1111 in which the default value is provided. Otherwise, if the pixel is within the defined region of the active LUT, then operation advances to block 1117 in which the waveform value corresponding to the pixel information is retrieved from the LUT, and then the waveform value is driven to the EPD panel 101 at next block 1119 for updating the corresponding pixel. Operation then loops back to block 1113.

A display controller according to one embodiment includes a pixel processor which processes working pixel data for each pixel of a frame, where the pixel processor includes an overlap detector, a collision detector, and a construction processor. The overlap detector detects an overlap region when any of at least one new pixel value of a new update region is within a current update region of a current update of the frame. The collision detector issues a correction request when at least one pixel within the overlap region has a begin pixel value prior to the current update that is different from an end pixel value provided by the current update, and when a new pixel value provided by the new update for at least one pixel is different from the end pixel value. The construction processor updates the corresponding working pixel data using a corresponding new pixel value for each pixel that is within the new update region and outside of the current update region.

The collision detector may issue the collision correction when the new pixel value is different from the end pixel value for at least one pixel within the overlap region even when the end pixel value is the same as the begin pixel value. Alternatively, when the new pixel value is different from the end pixel value and when the begin pixel value is the same as the end pixel value for at least one overlap pixel within the overlap region, the construction processor may update the working pixel data of each overlap pixel by reassigning it to the new update including replacing the end pixel value of the overlap pixel with the new pixel value. The collision detector may not issue a correction request when, for each overlap pixel within the overlap region, a corresponding new pixel value provided by the new update is the same as a corresponding end pixel value or when the overlap pixel is reassigned to the new update. Alternatively, the collision detector may not issue the correction request when a corresponding new pixel value provided by the new update is the same as a corresponding end pixel value for each overlap pixel within the overlap region.

The display controller may include a display processing system which converts the working pixel data to waveform information during sequential scan updates of the frame. The conversion includes converting working pixel data for the new update region concurrently with converting working pixel data for the current update region for at least one scan update of the frame when the overlap region is detected.

A display system according to one embodiment includes buffers, a processing unit, and a display controller. A working buffer stores working pixel data for each pixel of a frame. The processing unit stores at least one update pixel value in an update buffer for a new update region of the frame. The display controller includes at least one fetch block, an overlap detector, a collision detector, and a construction processor. The fetch block retrieves each new pixel value of the new update region from the update buffer for each new update, and retrieves corresponding working pixel data from the working buffer. The overlap detector detects an overlap region when any pixel of the new update region is within a current update region of a current update of the frame. The collision detector issues an interrupt to the processing unit when the overlap region is detected and when at least one pixel within the overlap region is being updated by the current update to an end pixel value which is different from a corresponding new pixel value provided by the new update for the at least one pixel within the overlap region. The construction processor updates the corresponding working pixel data in the working buffer using a corresponding new pixel value from the update buffer for each pixel that is within the new update region and outside of the current update region.

The display system may include a display processing system which converts the working pixel data from the working buffer to waveform information during sequential scan updates of the frame. Such conversion may include converting working pixel data for the new update region concurrently with converting working pixel data for the current update region for at least one scan update of the frame when the overlap region is detected.

A method of processing pixel information for a display panel according to one embodiment includes detecting a new update for a new update region of a frame of pixels, receiving a new value for each of at least one pixel within the new update region and receiving corresponding working pixel data for the at least one pixel, detecting an overlap region when the new update temporally overlaps at least one current update and when the new update region spatially overlaps at least one current update region of the at least one current update, when the overlap region is detected, for each pixel of the new update region that is not within the overlap region, updating the corresponding working pixel data before completion of the at least one current update, and for each overlap pixel within the overlap region, detecting a collision when the overlap pixel is being updated by the at least one current update to an end value which is different from a new value of the new update, and when a collision is detected, issuing a correction request to correct at least one pixel within the overlap region.

The method may include detecting a collision whenever the end value is different from the new value regardless of whether the overlap pixel is being updated by the at least one current update. The method may include reassigning an overlap pixel to the new update by replacing an end value within corresponding working pixel data with a corresponding new value when the corresponding new value is different from the end value and when the overlap pixel is not being updated by the at least one current update. The method may include detecting a collision for an overlap pixel only when the overlap pixel is being updated by the at least one current update and is not reassigned to the new update. The method may include, for each new update, converting working pixel data for each pixel of the frame to waveform information during sequential scan updates of the frame until the new update is completed, and when the overlap region is detected, concurrently converting working pixel data updated by the new update and converting working pixel data updated by the at least one current update for at least one scan update of the frame.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for carrying out the same purposes of the present invention without departing from the spirit and scope of the invention as defined by the appended claims.

The invention claimed is:

1. A display controller, comprising:

a pixel processor for processing working pixel data for a plurality of pixels of a frame, said pixel processor comprising:

an overlap detector which detects an overlap region when at least one pixel is within a new update region of a new update is also within a current update region of a temporally overlapping current update of said frame;

a collision detector which issues a correction request to request a different and subsequent update upon detection of any colliding pixel within said overlap region that corresponds with a begin pixel value and an end pixel value of said current update in which said begin pixel value is different from said end pixel value and which corresponds with a new pixel value provided by said new update that is different from said end pixel value; and a construction processor which updates working pixel data for each pixel corresponding with one of at least one new pixel value of said new update and that is within said new update region and outside of said current update region and which does not update working pixel data for said any colliding pixel; and a display processing system which simultaneously updates at least one pixel within said current update region and outside said overlap region and at least one pixel within said new update region and outside said overlap region.

2. The display controller of claim 1, wherein said collision detector issues said correction request to request said subsequent update upon detection of any colliding pixel of said new update and within said overlap region for which said new pixel value is different from said end pixel value and for which said end pixel value is the same as said begin pixel value of said current update.

3. The display controller of claim 1, wherein when said new pixel value is different from said end pixel value and when said begin pixel value is the same as said end pixel value for at least one overlapping pixel within said overlap region, said construction processor updates said working pixel data of each of said at least one overlapping pixel by reassigning said overlapping pixel to said new update including replacing said end pixel value of said overlapping pixel with said new pixel value.

4. The display controller of claim 3, wherein said collision detector does not issue said correction request when, for each overlapping pixel within said overlap region, a corresponding new pixel value provided by said new update is the same as a corresponding end pixel value or when said overlapping pixel is reassigned to said new update.

5. The display controller of claim of claim 1, wherein said collision detector does not issue said correction request when a corresponding new pixel value provided by said new update is the same as a corresponding end pixel value for each overlapping pixel within said overlap region.

6. The display controller of claim of claim 1, wherein said display processing system converts said working pixel data to waveform information during sequential scan updates of said frame, including converting working pixel data for said new update region concurrently with converting working pixel data for said current update region for at least one scan update of said frame when said overlap region is detected.

7. A display system, comprising:

an update buffer and a working buffer, wherein said working buffer stores working pixel data for each of a plurality of pixels of a frame;

a processing unit which stores at least one update pixel value in said update buffer for a new update corresponding with a new update region of said frame; and a display controller, comprising:

at least one fetch block which retrieves each of said at least one new pixel value from said update buffer for each new update, and which retrieves corresponding working pixel data from said working buffer;

an overlap detector which detects an overlap region when any pixel of said new update region is within a current update region of a current update of said frame;

a collision detector which issues an interrupt to said processing unit when said overlap region is detected and when at least one pixel within said overlap region is being updated by said current update to an end pixel value which is different from a corresponding new pixel value provided by said new update for said at least one pixel within said overlap region; and a construction processor which updates said corresponding working pixel data in said working buffer using a corresponding one of said at least one new pixel value from said update buffer for each pixel that is within said new update region and outside of said current update region before said current update is completed.

8. The display system of claim 7, wherein said collision detector issues said interrupt whenever said end pixel value is different from said corresponding new pixel value for at least one pixel within said overlap region even when said at least one pixel within said overlap region is not being updated by said current update.

9. The display system of claim 7, wherein whenever said end pixel value is different from said corresponding new pixel value for at least one overlapping pixel within said overlap region that is not being updated by said current update, said construction processor updates said working pixel data of each of said at least one overlapping pixel by reassigning said overlapping pixel to said new update and by replacing said end pixel value with said new pixel value.

10. The display system of claim 9, wherein said collision detector does not issue said interrupt when, for each of said at least one overlapping pixel within said overlap region, a corresponding new pixel value provided by said new update is the same as a corresponding end pixel value or when said overlapping pixel is reassigned to said new update.

11. The display system of claim 7, wherein said collision detector does not issue said interrupt when a corresponding new pixel value provided by said new update is the same as a corresponding end pixel value for each pixel within said overlap region.

12. The display system of claim 7, wherein said display controller further comprises a display processing system which converts said working pixel data from said working buffer to waveform information during sequential scan updates of said frame, including converting working pixel data for said new update region concurrently with converting working pixel data for said current update region for at least one scan update of said frame when said overlap region is detected.

13. The display system of claim 12, wherein said display controller further comprises:

a plurality of lookup tables, wherein each of said plurality of lookup tables is active when assigned to an update, is released when said update is completed, and is inactive when not assigned to any update, and wherein each active lookup table includes a corresponding update region;

wherein said working pixel data for each of said pixels of said frame includes a lookup number indicating one of said plurality of lookup tables;

wherein said overlap detector detects said overlap region when a lookup table indicated by said corresponding working pixel data is active and when said any pixel of said new update region is within an assigned update region of said indicated lookup table; and an update frame controller which programs each active one of said plurality of lookup tables with waveform values prior to said scan update.

14. A method of processing pixel information for a display panel, comprising:

detecting a new update for a new update region of a frame of pixels;

receiving a new value for at least one pixel within the new update region and receiving corresponding working pixel data for the at least one pixel;

detecting an overlap region when the new update temporally overlaps at least one current update and when the new update region spatially overlaps at least one current update region of the at least one current update;

when the overlap region is detected, for each pixel of the new update region that is not within the overlap region and for which a new value is received, updating the corresponding working pixel data;

when the overlap region is detected, for each overlapping pixel within the overlap region, detecting a collision when the overlapping pixel is being updated by the at least one current update to an end value which is different from a new value of the new update;

for each collision that is detected within the overlap region, performing no new pixel construction for the corresponding working pixel data for the corresponding overlapping pixel;

simultaneously updating at least one pixel within the current update region of the frame and outside the overlap region and at least one pixel within the new update region of the frame and outside the overlap region; and when at least one collision is detected, issuing a correction request for a different and subsequent update.

15. The method of claim 14, wherein said detecting a collision comprises detecting a collision for each overlapping pixel in which a corresponding end value of the at least one current update is different from a corresponding new value of the new update.

16. The method of claim 14, further comprising reassigning an overlapping pixel to the new update by replacing an end value within corresponding working pixel data with a corresponding new value when the corresponding new value is different from the end value and when the overlapping pixel is not being updated by the at least one current update.

17. The method of claim 16, wherein said detecting a collision comprises detecting a collision for an overlapping pixel only when the overlapping pixel is being updated by the at least one current update and is not reassigned to the new update.

18. The method of claim 14, further comprising:

for each new update, converting working pixel data for each pixel of the frame to waveform information during sequential scan updates of the frame until the new update is completed; and when the overlap region is detected, said converting comprising concurrently converting working pixel data updated by the new update and converting working pixel data updated by the at least one current update for at least one scan update of the frame.

19. The method of claim 14, further comprising:

upon detecting an update, activating one of a plurality of lookup tables by assigning it to the update and to a corresponding update region;

programming each activated lookup table with waveform values prior to each scan update of the frame; and deactivating an activated lookup table when a corresponding update is completed.

20. The method of claim 19, wherein said detecting an overlap region comprises:

determining whether a table number stored the corresponding working pixel data indicates an active one of the plurality of lookup tables; and when the table number in the corresponding working pixel data indicates an active one of a plurality of lookup tables, detecting an overlap region when a pixel location of the corresponding working pixel data is within a region assigned to the active one of the plurality of lookup tables.

* * * * *